United States Patent [19]

McBride Daniel Taylor

[11] Patent Number: 4,934,008

[45] Date of Patent: Jun. 19, 1990

[54] METHOD FOR PATTERNING DYED SUBSTRATES

[75] Inventor: McBride Daniel Taylor, 3412 Fairfield Rd., Chesnee, S.C. 29323

[73] Assignee: Milliken Research Corporation, Spartanburg, S.C.

[21] Appl. No.: 399,364

[22] Filed: Aug. 28, 1989

Related U.S. Application Data

[63] Continuation of Ser. No. 180,405, Apr. 12, 1988, abandoned.

[51] Int. Cl.[5] ..... D06B 1/02; D06B 11/00

[52] U.S. Cl. ..... 8/149; 8/149.1; 8/151; 8/158; 68/5 A; 68/5 D; 68/205 R

[58] Field of Search ..... 8/149, 149.1, 151, 158, 8/483, 484, 505, 932; 68/5 A, 5 D, 200, 202, 203, 205 R

[56] References Cited

FOREIGN PATENT DOCUMENTS 2411027 9/1975 Fed. Rep. of Germany ..... 8/483

*Primary Examiner*—Philip R. Coe

*Attorney, Agent, or Firm*—George M. Fisher; H. William Petry

[57] ABSTRACT

A method and apparatus for patterning a substrate wherein liquid unfixed dye is applied to the substrate. One or more streams of pressurized gas such as air then directed onto the substrate for the purpose of displacing some of the unfixed dye where the streams impinge the substrate, thereby causing a visually distinctive area on the substrate where the relative dye concentration is reduced.

6 Claims, 8 Drawing Sheets

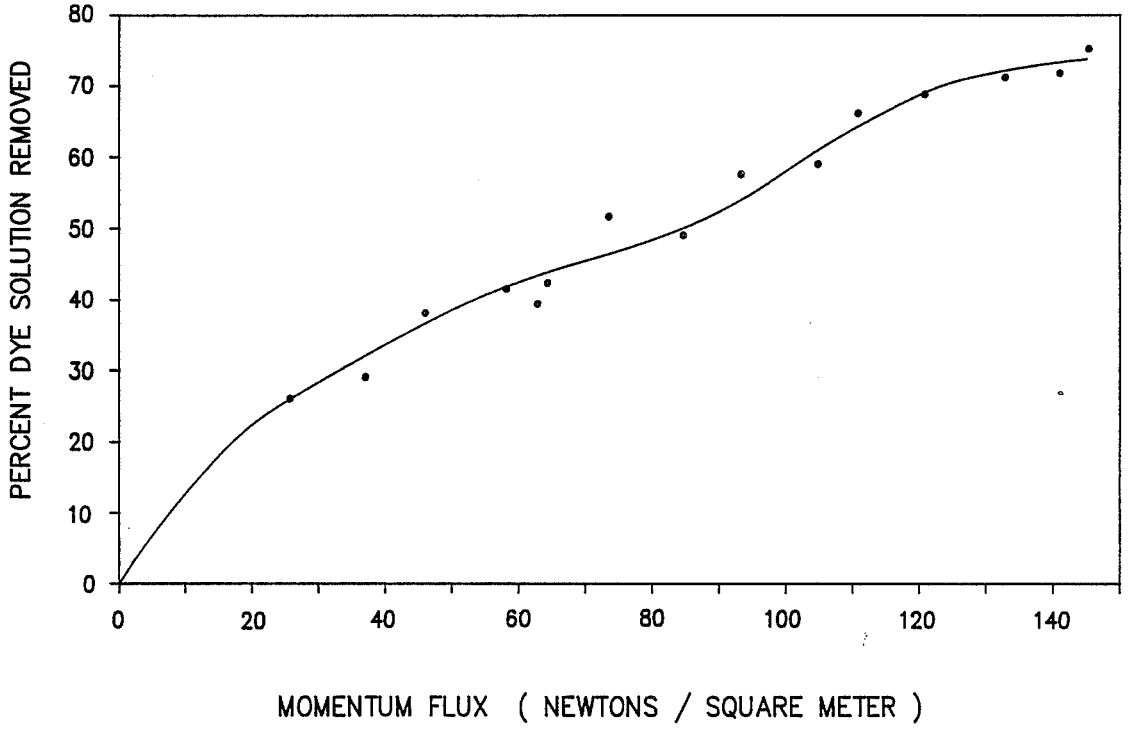
*FIG. —14—*

METHOD FOR PATTERNING DYED SUBSTRATES

This application is a continuation of application Ser. No. 180,405 filed on Apr. 12, 1988, and now abandoned.

This invention relates to an apparatus and process for generating patterns on textile substrates carrying unfixed liquid dyes. More particularly, this invention is directed to an apparatus and process for patterning textile substrates wherein at least one stream or jet of pressurized gas is directed at the surface of a textile substrate to which has been applied an undried and unfixed liquid dye or other patterning agent.

In one preferred embodiment, a textile substrate which has been dyed a uniform color using an unfixed and undried liquid dye is subjected to one or more jets of air at relatively close range. The mechanical action of the impinging jet or stream on the unfixed dye is sufficient to displace or remove, from the area of impact, dye which has not been adsorbed onto the surface of the constituent fibers, thereby removing or redistributing unfixed dye and causing the area of impact to have a significantly lower dye concentration in the area of jet impingement. This area, upon fixing of the dye, is therefore dyed a visually lighter or less saturated shade of the dye than the surrounding non-impacted area.

It should be emphasized that the manner in which dye is initially placed on the substrate is unimportant, so long as the dye remains unfixed and/or capable of removal or redistribution by the impinging gas streams.

As used herein, the term liquid dye shall be used to mean dyes, inks, or the like comprised of soluble matter in a solvent, as well as dyes or marking materials comprised of insoluble matter in a liquid medium. The term substrate is intended to encompass a wide range of textile constructions, such as woven or knitted fabrics, and may include non-woven constructions. Both flat and pile-like fabrics have been successfully patterned using the teachings herein, and are intended to be included in the term textile substrate as well. Fabrics comprised of various synthetic yarn types may be used including, but not limited to, polyester, nylon, and acrylic yarns. It is believed any yarn type or fabric construction which allows some unfixed liquid dye to be redistributed or removed by the action of an impinging gas stream may be patterned using the teachings herein. As used herein, the term "momentum flux" is used to describe the relative concentration of momentum of the gas stream (i.e., the product of gas mass and gas velocity) striking the substrate. By using momentum flux as a parameter, various other process variables such as gas pressure, gas stream velocity at impact, and gas stream cross-sectional area may be implicitly accommodated.

Many techniques are known to apply dye to a textile substrate for the purpose of patterning the surface of the substrate. Among the most common is the direct application of dye of the desired colors to a previously dyed or undyed substrate. This technique is known as direct printing. Perhaps the most widely used direct printing technique is screen printing, in which dye or ink is forced through a specially prepared screen onto a substrate. The screen has areas in which the mesh has been blocked. These areas, which remain impervious to the dye or ink, correspond to pattern areas on the substrate in which no ink or dye is desired. Another direct printing method is known as metered jet printing, in which dye is selectively applied to an untreated substrate surface by one or more streams of dye which are positioned to strike the substrate surface as the substrate moves under or through the dye streams. The streams may be either continuously flowing onto the substrate surface, or may be intermittently initiated or interrupted, in a variety of ways, in accordance with pattern data. This method, which may afford some flexibility in pattern configuration, often requires a complex arrangement of valves and dye discharge devices which are costly and may require careful or continuing adjustment.

A characteristic of either technique is the limitation of shade flexibility generally afforded by such techniques due to the practical need to use a separate dye mix for each desired shade, and the limited number of dye mixes usually available for each substrate pass.

Another printing technique is resist printing, wherein a resist chemical is first applied to a dyed or undyed substrate in a specified area. The resist chemical can contain a dye or pigment. After fixing the resist, the substrate surface may be applied with a dye which, due to the blocking effect of the resist, does not affect the areas under the resist. Because of the multiple steps required, this process is more costly than applying a single batch of dye directly to the substrate. Furthermore, the control of color intensity or shading must be accomplished through the use of carefully formulated resist chemicals. Generally, it is difficult to achieve even moderately fine gradations of shading with this technique.

Discharge printing is yet another printing technique wherein a previously dyed or undyed substrate is dyed overall with a background shade, after which a chemical agent is applied to the substrate to discharge or reduce the color of the background shade and eliminate, at least partially, the background shade from that area of the substrate. The background dye mix can contain dyes resistant to reduction by the discharge agent. In areas containing such dyes, the background color will remain. In addition, the discharge mix can itself contain dyes which are intended to replace or re-dye areas from which the original background dye has been chemically reduced. This technique requires highly specialized and expensive dyes, and is difficult to control if fine or uniform shade gradations are desired to be reproduced dependably.

These methods all provide acceptable results under some circumstances, but all share shortcomings which have been overcome by embodiments of the invention disclosed herein. In particular, all the above-mentioned techniques require carefully controlled formulations of dye and/or dye modification agents to be effective, and further require that, for each desired color shade, a separate formulation of dye or dye modification agent be used, or that the residence time of the dye modification agent be carefully controlled. Each such formulation must be made up in advance, and must be loaded into the appropriate patterning equipment prior to the start of the patterning operation. Once under way, desired variations in the pattern or shading are limited to those possible with the existing mix of dyes and/or dye modification agents. In addition, all these conventional techniques are ill-suited to generate softly-defined patterns characterized by regular or random-appearing dyed areas having diffuse, unobtrusively blended perimeters and wide shade variations within the dyed areas.

The invention disclosed herein provides a method for dyeing a textile substrate with a variety of shade variations of a given background, without the uncertainty associated with resist or discharge printing techniques, and without the inflexibility or complexity associated with certain direct printing techniques. Specifically, the invention provides a method in which a variety of shade variations may be reproducibly generated on a moving textile substrate by removing or redistributing, in a controlled, selective manner, unfixed and undried liquid dye from the substrate to produce various color shades and patterns. The manner in which the dye is placed initially on the substrate depends upon the nature of the final pattern desired. In a preferred embodiment, the unfixed liquid dye is applied uniformly over the fabric to be patterned, and is then removed or redistributed in its unfixed state by the impingement of one or more jets of air to form a pattern. This results in a pattern limited to the various shades of the applied color, in combination with the initial color of the substrate. Of course, other techniques for applying the dye to the substrate for subsequent removal or redistribution using the novel techniques disclosed herein may be readily conceived by those skilled in the art.

In accordance with the invention, unfixed and undried liquid dye on a substrate surface may be removed or redistributed by one or more streams or jets of pressurized gas directed at close range onto selected areas of the substrate surface. For purposes of discussion, air at substantially ambient temperature will be assumed to be the gas of choice, although other gases may be used as desired. By controlling the various parameters associated with the delivery of air onto the substrate, a variety of shade variations may be produced, each shade being represented by a given reduced quantity per surface area of the liquid dye on the fabric surface. Where only a relatively small amount of unfixed dye has been removed over a given area by the impinging air stream, the resulting shade will be relatively close to the background color generated by the fully concentrated dye. Removing a relatively larger amount of dye from the area will result in a more "diluted" color or tone being generated, as viewed against the fully concentrated background level of unfixed dye. The resulting color may be a blend of the unfixed background dye color and the color of the substrate prior to the application of the unfixed dye. It is therefore possible to obtain multicolor effects based upon the blending of the underlying substrate color and various concentrations of the unfixed dye. Of course, the application of unfixed dye in multiple colors onto a background of fixed dye (of one or more than one color) is also contemplated.

In practice, application of the background color by padding or other means in which dye thoroughly contacts all exposed fiber surfaces results in a uniformly dyed surface in which removal of significant quantities of the dye from such fiber surfaces requires significantly more momentum flux using the techniques and parameters of the instant invention than is necessary for removal of dye which has been topically applied.

Where multiple colors are desired, the prompt application of a second liquid dye to a substrate surface still wet from an initial application of dye results in the second color coating on the surface being relatively easy to remove using the teachings herein. It is believed that a substantial amount of the first or base layer of applied dye is adsorbed onto the fiber surfaces and becomes securely attached thereto, even though unfixed. Subsequent applications of dye must look to areas of the fiber surface not yet occupied by a component of the first dye to find an adsorption site, or, finding no adsorption site, must occupy the interstitial voids between adjacent fibers or yarns. This results in the second dye having a relatively low and/or weak adsorption level, and permits substantial quantities of the second dye to be more readily removed or redistributed in accordance with the teachings described herein.

A special advantage of this invention is that the chosen shade variations may be modified while the substrate is being patterned—no prior preparation in the nature of formulating special dyes or other chemicals, or loading the patterning device with such dyes or chemicals, is required. Additionally, the process may be implemented using the computer controlled apparatus disclosed herein. As aided by such computer controlled apparatus, the invention may provide the following practical advantages:

(1) shade and pattern changes may be made at any time during the patterning process;

(2) variations in both shade and pattern may be made in carefully controlled and repeatable increments;

(3) computer generated patterns may be easily stored for reuse at any time;

(4) complex patterns involving pattern changes across the full width of the substrate may be easily accomplished, and may be reproduced on demand.

Further features and advantages of this invention will be made evident by the following detailed description, when read in conjunction with the accompanying drawings, in which.

Figure 1:
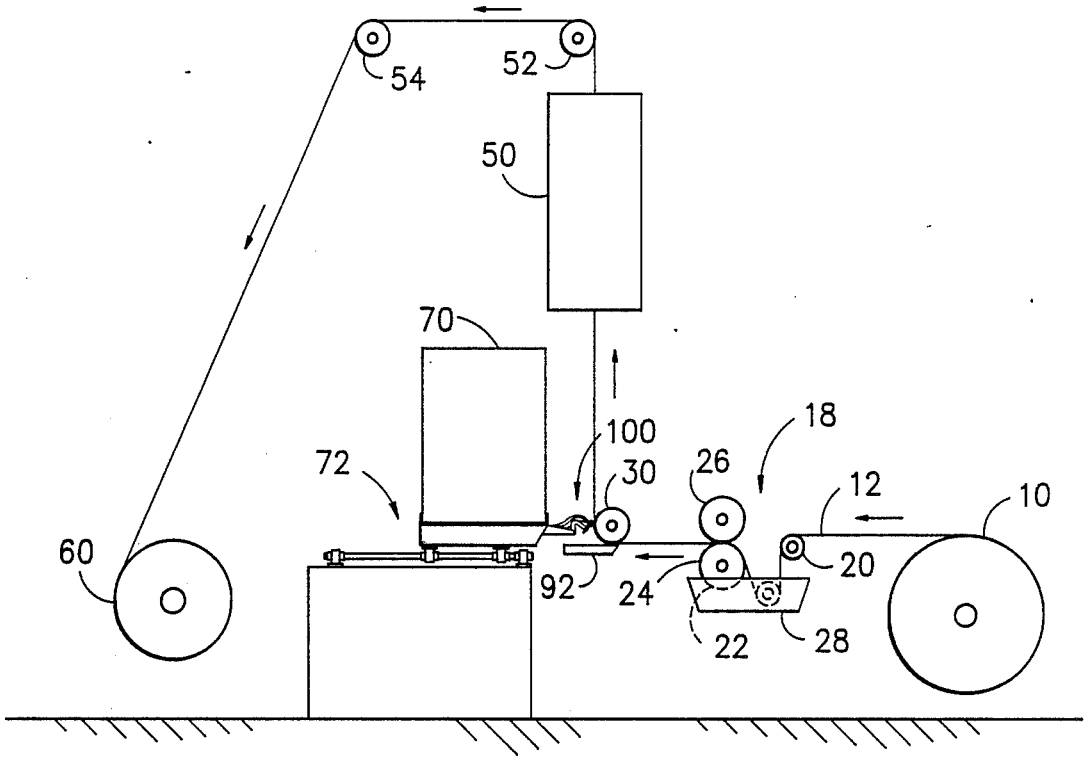
FIG. 1 is a schematic elevation view of one embodiment of an apparatus as disclosed herein for removing or redistributing dye in a pattern configuration, as adapted for use primarily with relatively non-porous substrates.
Figure 2:
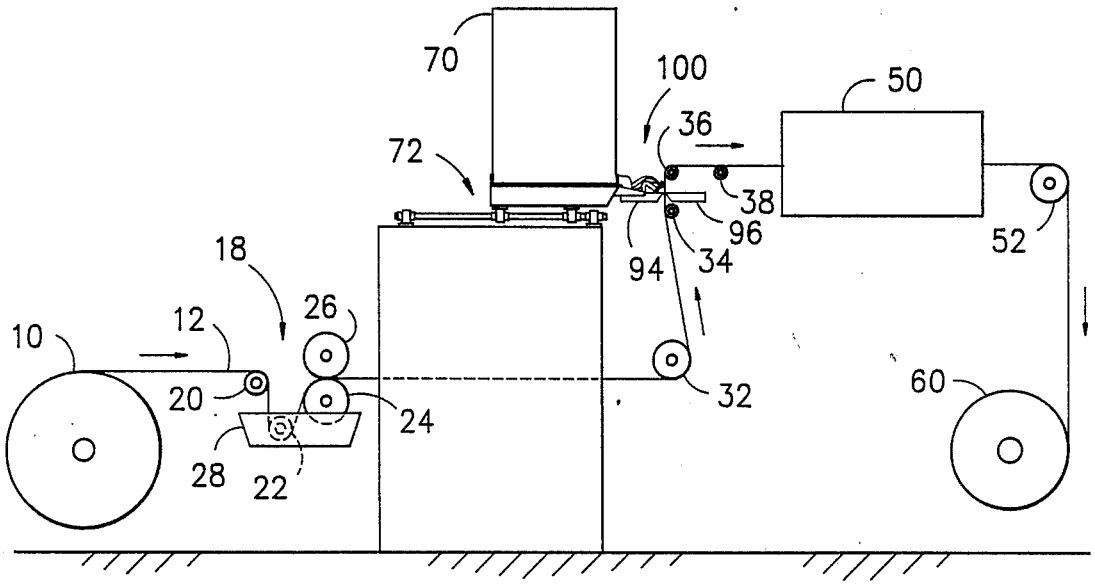
FIG. 2 is a schematic elevation view of a second embodiment of an apparatus as disclosed herein for removing or redistributing dye in a pattern configuration, as adapted for use primarily with relatively porous substrates.
Figure 3:
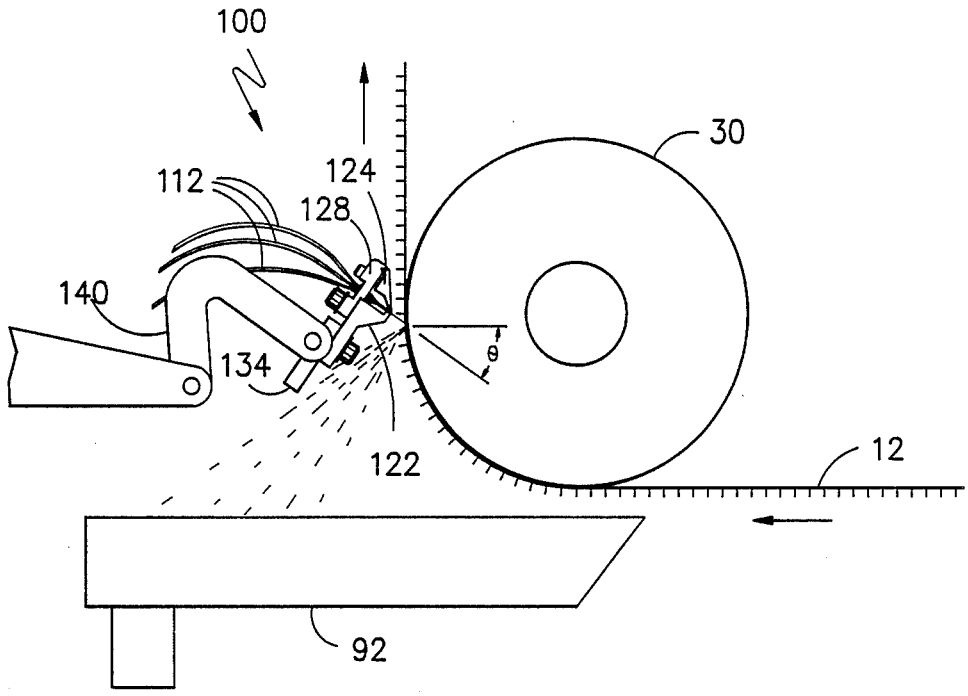
Figure 4:
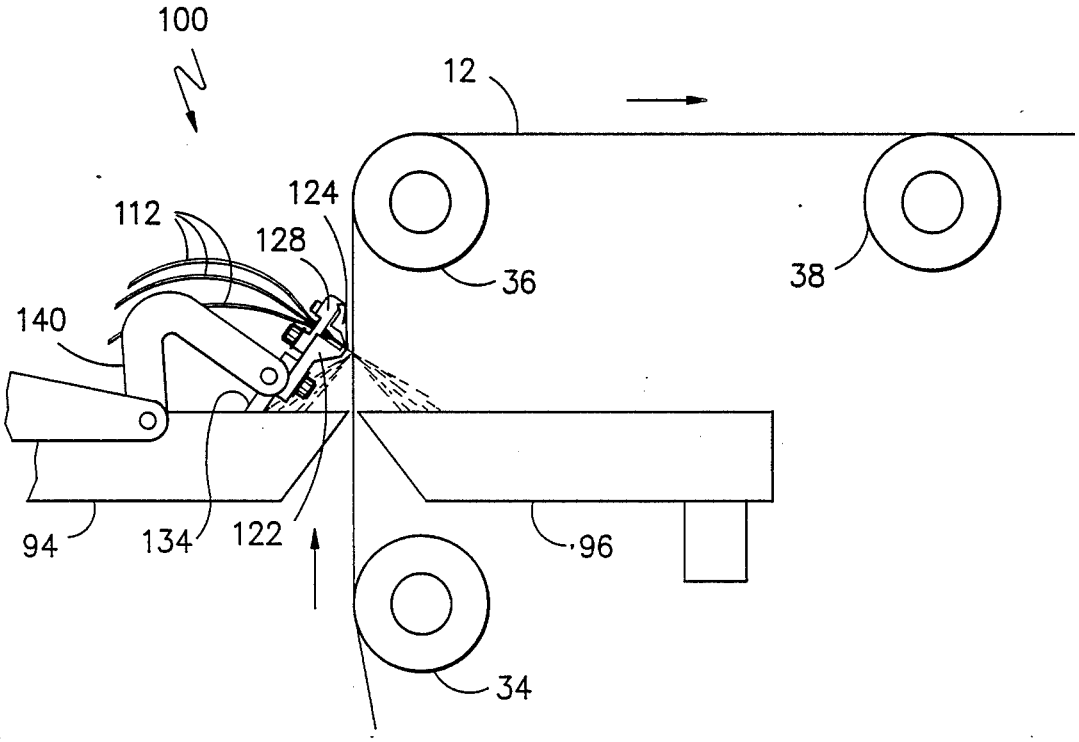
Figure 5:
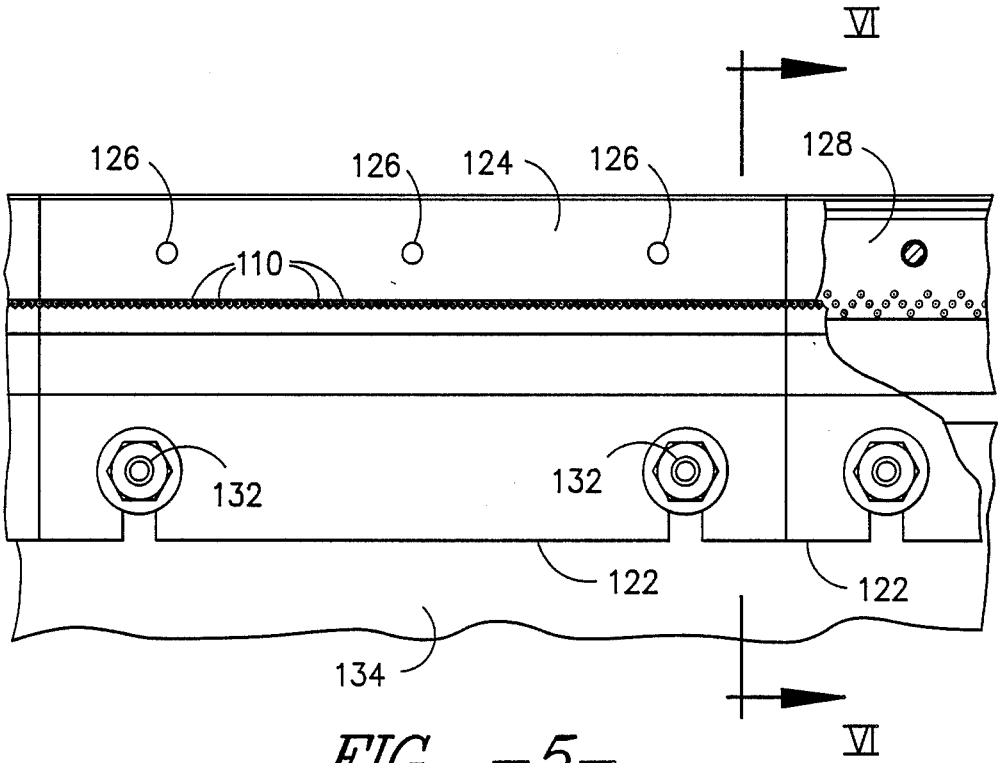
Figure 6:
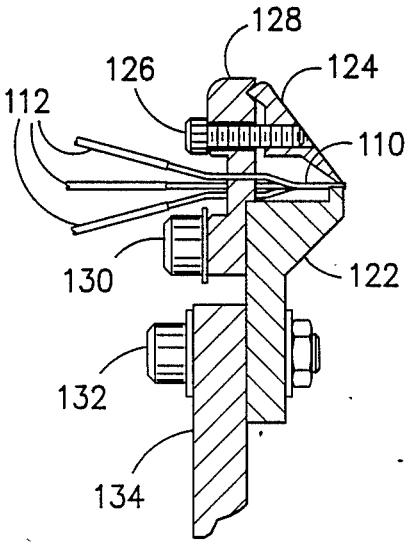
Figure 7:
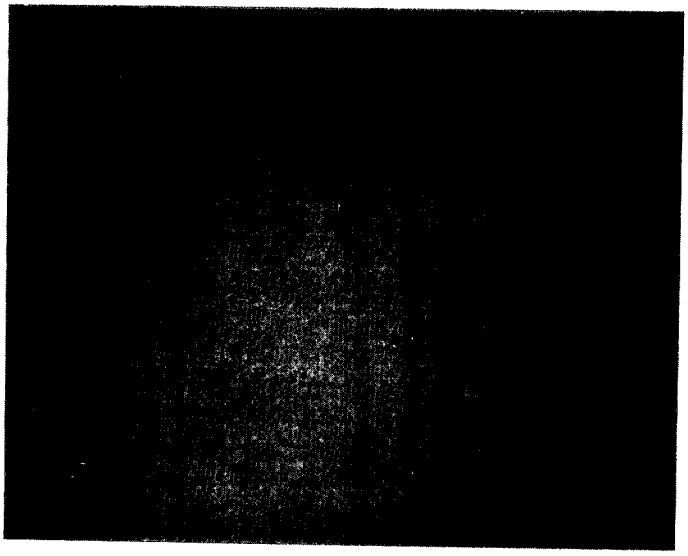
Figure 8:
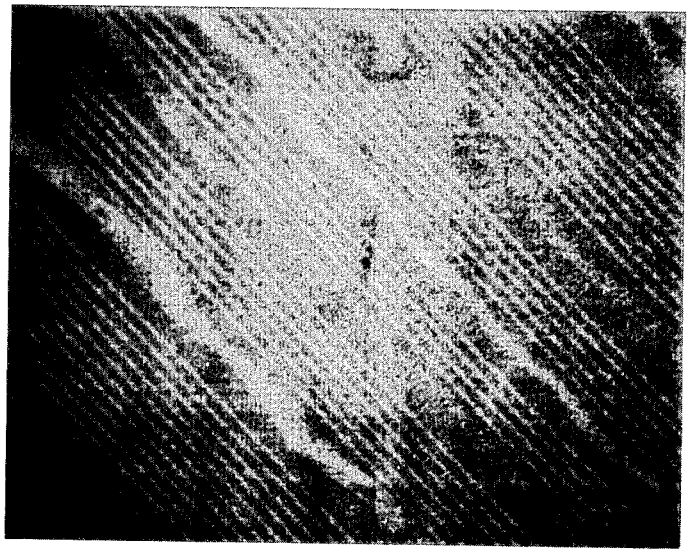
Figure 9:
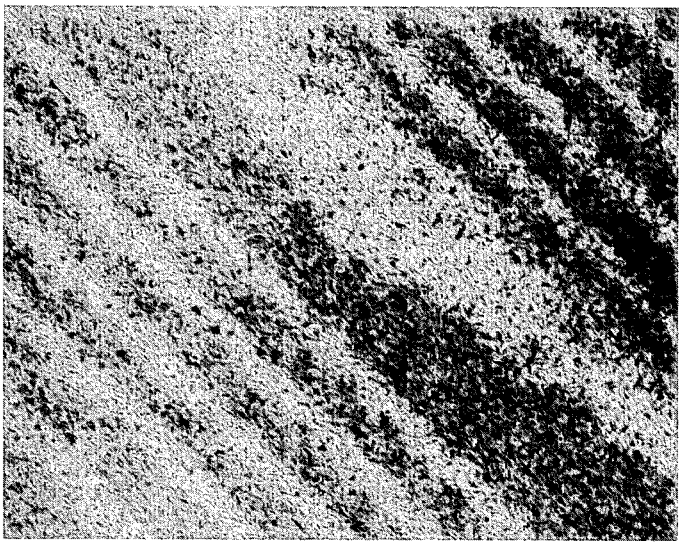
Figure 10:
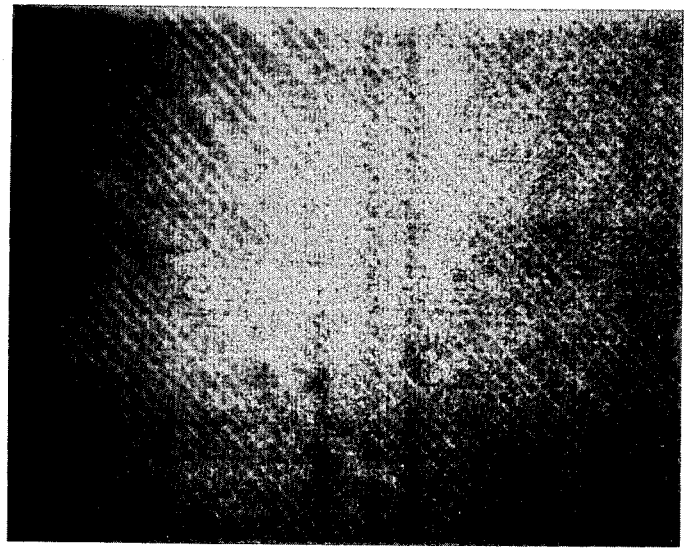
Figure 11:
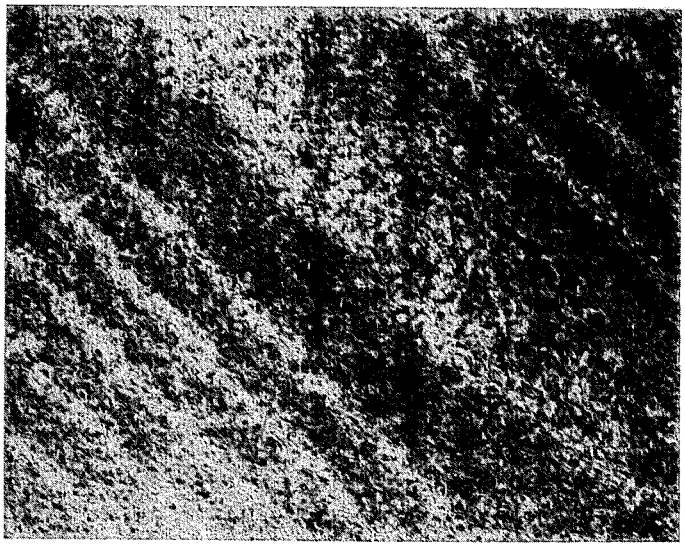
Figure 12:
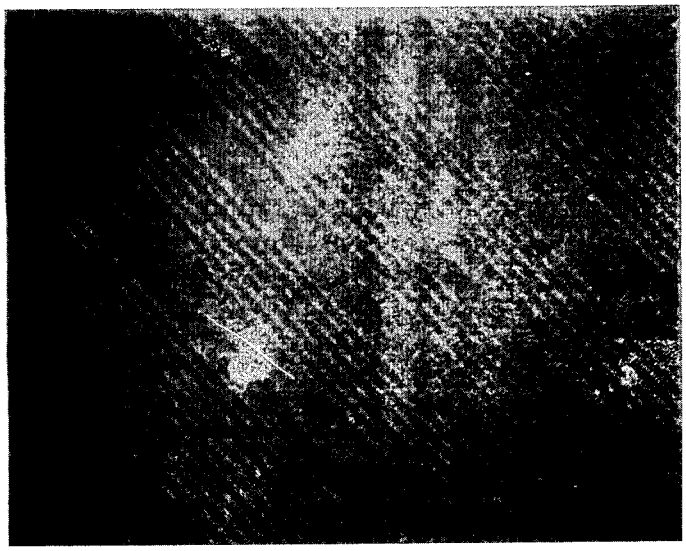
Figure 13:
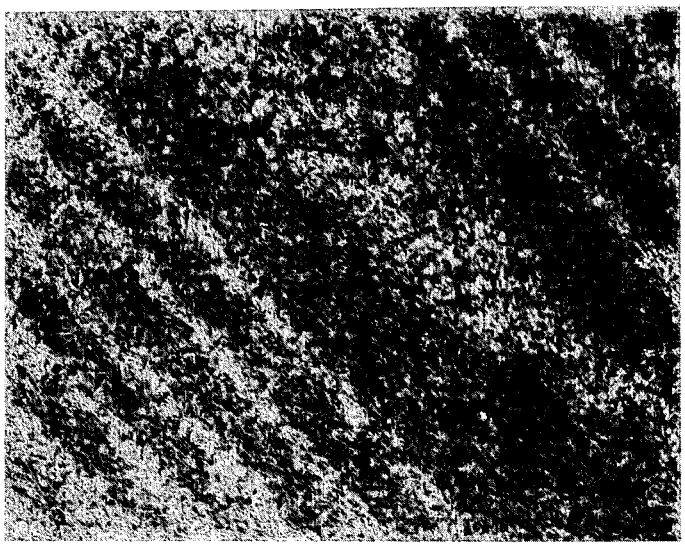

FIG. 3 schematically depicts the patterning portion of the apparatus of FIG. 1, wherein the jet is directed against a backing member;

FIG. 4 schematically depicts the patterning portion of the apparatus of FIG. 2, wherein the jet penetrates the substrate and no directly opposing backing member is used;

FIG. 5 is a frontal view of a jet array for use in the apparatus of FIGS. 1–4;

FIG. 6 is a sectional view, taken along line VI—VI, of the array of FIG. 5;

FIG. 7 is a photomicrograph (0.38×) of a "control" fabric for Examples 1–3;

FIGS. 8 and 9 are photomicrographs (0.38× and 1.9×, respectively) of the patterned fabric of Example 1;

FIGS. 10 and 11 are photomicrographs (0.38× and 1.9×, respectively) of the patterned fabric of Example 2;

FIGS. 12 and 13 are photomicrographs (0.38× and 1.9×, respectively) of the patterned fabric of Example 3;

FIG. 14 is a plot showing the effect of increasing momentum flux on percentage of liquid dye removed. Depicted in FIGS. 1 and 3 and FIGS. 2 and 4, respectively, are alternative apparatus configurations for treating textile substrates in which (1) the gas jets are intended to be reflected from the textile structure and the underlying backing member almost exclusively (FIGS. 1 and 3), and (2) the gas jets are intended primarily to pass through the substrate, but with some of the gas being reflected by the yarns comprising the fabric substrate (FIGS. 2 and 4). As shown in FIGS. 1 and 2, textile substrate 12 in continuous web form is directed from supply roll 10 through conventional dye bath 18 where a liquid dye is applied to the substrate web. In the embodiment depicted, bath 18 is comprised of four rolls: a driven roll 20, roll 22, which is at least partially submerged in a liquid dye contained in dye trough 28, and opposed driven rolls 24,26, which form a nip of adjustable dimension. Rolls 24,26 may serve two functions: (1) to pull the web through the bath and (2) to squeeze a desired portion of liquid dye from the substrate. The latter function is desirable under normal circumstances to remove excess dye for the purpose of subsequent re-use, as well as to minimize the energy necessary to dry and fix the dye on the substrate. Nip rolls 24,26 also serve to adjust the moisture content of the substrate to vary the effects produced by the impinging jet used to pattern the substrate in accordance with the teachings herein. Other dye bath roll configurations, or entirely different means to apply dye to the substrate, may be used.

Following application of liquid dye to the substrate 12, the web is directed over one or more rolls positioned generally opposite impinging jet array 100. In the embodiments shown in FIGS. 1 through 6, jet array 100 is comprised of a series of parallel, closely spaced tubes 110 (FIG. 6) of relatively small diameter directed at the surface of substrate 12. Each tube is connected to a respective flexible conduit 112 through which pressurized gas is supplied. The outlets of tubes 110 are arranged at a uniform distance from the surface of substrate 12 within array alignment plate 122, shown in cross-section in FIG. 6, which holds individual tubes 110 in rigid alignment as discussed hereinbelow.

As shown in more detail in FIGS. 5 and 6, tubes 110 are arranged in a linear array with minimal spacing between adjacent tubes. One side of each tube 110 is positioned within an individual "V" shaped notch or groove along the lip of an alignment plate 122 which is fastened securely to array bar 134. Opposite plate 122 is positioned pressure plate 124, which contacts the side of each tube 110 protruding from the confines of each "V" shaped notch or groove in alignment plate 122. The action of pressure plate 124 and adjusting bolt 126 urging tubes 110 snugly into their respective notches in alignment plate 122 allows for rigid, repeatable alignment of the outlets of tubes 110 above the surface of substrate 12.

As depicted in FIG. 6, each tube 110 is bent to facilitate side-by-side tube arrangement having minimal adjacent tube spacing measured along the axis of alignment plate 122. Tubes 110 each pass through a drilled passage in support plate 128, which, as shown, is attached to alignment plate 122 via attachment bolts 130. The drilled passages of FIGS. 5 and 6 are depicted in a three hole, quasi-sinusoidal configuration; of course, other configurations may be used. For ease of fabrication, assembly, and maintenance, alignment plate 122, pressure plate 124, and support plate 128 may each be configured in relatively short, abutting sections which are attached to array bar 134 extending across the width of substrate 12. As depicted, array bar 134 is adjustably attached to articulated linkage 140, whereby the array may be adjustably positioned with respect to substrate 12 for patterning, changing substrates, cleaning of the array, etc.

Tubes 110 are each attached to individual conduits 112 through which is supplied pressurized gas of the desired kind. As discussed earlier, air at ambient temperature is preferred, but other gases may be used if desired. In a preferred embodiment, each conduit 112 is associated with an individual valve, not shown, which is electrically or pneumatically controlled by externally supplied patterning information, thereby allowing the pressurized gas to flow through any individual conduit 112 and associated tube 110 and onto the substrate 12 only in response to pattern information. The individual valves and perhaps the source of pattern information (which may be a read-only memory associated with an appropriate computer) may be located in housing 70, as shown in FIGS. 1 and 2. To facilitate positioning the array close to the substrate for patterning but away from the substrate for maintenance, changing substrates, etc., housing 70, to which is attached array 100, may be mounted on sliding carriage 72.

Looking now in detail at the apparatus of FIGS. 1 and 3, substrate 12, which may have a pile face, as depicted, or which may be a flat fabric, is directed through an approximate 90° wrap angle around single support roll 30. In a preferred embodiment, roll 30 is smooth and solid, but a foraminous or contoured roll surface may be employed if special patterning effects are desired. Wrap angles other than 90° may be used as desired. However, it is preferred that the substrate to be patterned in this configuration be in contact with the support roll 30 at the point where the jets contact the substrate. This minimizes any tendency of the substrate to oscillate or flap in response to the jet impingement. It also assures maximum reflection of gas and liquid dye from the fabric surface and underlying support surface where the principal mechanism of dye removal is intended to be dye droplets ejected from the face of the substrate. This is the mechanism of choice where the substrate construction used is relatively impervious to the gas jets of the kind contemplated herein, as, for example, where back-coated substrates are used, but may be employed, using a solid backing roll, for any type fabric to produce a characteristic effect.

Depending upon the fabric construction, the gas jet may penetrate the substrate only to a depth of a fraction of a yarn diameter, or may penetrate the substrate until encountering an impenetrable barrier such as a back coating or the surface of the backing roll. The jet is then redirected outwardly from the barrier and substrate. In all cases, the impact of the jet on the substrate causes redistribution of the liquid dye held by the substrate in the area of impact. Specifically, the liquid dye is "squeezed" from the substrate within the area of impact and accumulates as a drop or globule on the substrate surface, and is ultimately ejected by the momentum of the outwardly redirected jet. Catch basin 92 may be used to collect and, if desired, recycle liquid dye ejected from the substrate.

The alternative apparatus configuration of FIGS. 2 and 4 is generally more suited to substrates which the gas jets will penetrate readily, and for which a principal dye removal mechanism will be via dye droplets blown entirely through the substrate and leaving the substrate from the back of the fabric. As shown in detail in FIG. 4, the substrate is positioned opposite jet array 100 via a pair of spaced rolls 34,36 which leave the fabric unsupported, except for web tension, in the region of jet impact. This unimpeded path through the substrate, when used with an appropriately chosen substrate construction (i.e., one which is readily penetrated by gas jets of the kind contemplated herein) results in a substantial part of the impinging gas passing through the substrate, pushing or carrying droplets of liquid dye with it in the direction of catch basin 96. Because some dye droplets also emerge from the face of substrate 12 due to reflective interactions with the individual yarns comprising substrate 12, a second catch basin 94 placed below the face of the substrate may be employed. If recycling of the dye is desired, catch basins 94,96 may be associated with dye recycling filters, pumps, etc., not shown.

In the embodiment of FIGS. 1 and 3, as well as the embodiment of FIGS. 2 and 4, the angle at which the gas jets are directed at the substrate (the impingement angle) may be adjusted over a wide range. It has been found that, although significant effects may be observed at any angle which allows the gas streams to impinge the fabric, a preferred impingement angle lies within the range of 0° to 60° , as measured from the perpendicular of the substrate at the region of impact, and as indicated by the angle $\theta$ in FIG. 3. The measurement of the impingement angle in the embodiment of FIG. 4 is similar. Impingement angles within the range of about 25° to about 45°, and particularly within the range of about 30° to about 40° , are especially preferred. While the preferred relative direction of substrate travel is as indicated in the Figures (i.e., jets directed against the direction of substrate travel), operation in the reverse direction may be desirable under some circumstances. When patterning a pile fabric, it has also been found generally advantageous, although not necessary, to orient the pile so that the action of the jets tends to lay the pile down further in the same direction, rather than raising the pile.

FIGS. 1 and 2 both depict a treatment zone 50 following the gas jet patterning station described hereinabove. It is contemplated that treatment zone 50 may be used for drying and fixing the pattern dyed substrate immediately following the patterning step and prior to storage of the pattern dyed fabric on take-up roll 60. As depicted, driven rolls 52,54 are used to assist in drawing the substrate web through patterning station and treatment zone 50 and onto take-up roll 60. If desired, of course, the patterned fabric containing unfixed liquid dye may be subjected to other treatments prior to drying and/or fixing.

The generation of uniform background shades upon which patterns may be imparted by jet array 100 may be achieved using the dye bath arrangement depicted at 18 in FIGS. 1 and 2, or by other appropriate means known in the art. It is contemplated that a wide variety of novel and visually attractive patterns may also be generated by jet array 100 acting upon a substrate which is non-uniformly dyed or, in particular, which is dyed in a pattern configuration immediately prior to exposure to jet array 100. Any technique for the pattern-wise application of dye to substrates may be used, so long as the pattern dyed substrate contains unfixed dye capable of being redistributed or removed by the action of an impinging stream of gas of the nature contemplated herein.

The process and apparatus disclosed herein has been used to pattern or color a variety of commercially available textile substrates, and has resulted in many visually distinctive effects. The following illustrative examples are intended to be representative only, and are not intended to be limiting in any way. Examples 1 through 3 demonstrate the embodiment of the invention wherein dyeing of the substrate was achieved using the patterning apparatus and process depicted in FIG. 3.

EXAMPLE 1

A tufted acrylic substrate of approximately 14 ounces per finished square yard, 19 stitches per inch and 25 tuft lines per inch was first padded with a conventional basic and disperse red dye solution. The wet pick up of the dye solution was about 60 percent based on the weight of the substrate. The web of acrylic substrate was then passed through the treating zone of the apparatus at about 10 linear yards per minute wherein a plurality of orifices (0.023 inch inside diameter and 25 orifices per linear inch across the web) impacted patterned air at approximately 50 pounds per square inch gauge (p.s.i.g.) supply pressure. The orifices were placed approximately 0.1 inch from the face of the substrate, at an impingement angle of approximately 35°. Here, selective removal of dye solution occurred in the form of a diagonal pattern comprising lines of varying widths on the face of the substrate. The substrate was then conventionally steamed, washed and dried. The resulting substrate is depicted in the photomicrographs of FIGS. 8 and 9 (0.38× and 1.9×, respectively). A depiction of a substrate treated as in Example 1, but not passed through the treating zone of the apparatus is shown in the photomicrograph (0.38×) of FIG. 7. The patterned substrate of FIGS. 8 and 9 is clear and exhibits high visual contrast as compared with the untreated areas of the substrate, shown in FIG. 7.

EXAMPLE 2

The procedure of Example 1 was repeated in all respects except the supply pressure was decreased to 30 p.s.i.g. The photomicrographs of FIGS. 10 and 11 (0.38× and 1.9×, respectively) show diminished contrast as compared with the patterned substrate of Example 1.

EXAMPLE 3

The procedure of Example 1 was repeated in all respects except the distance the orifices were located from the face of the substrate was changed to approximately 0.2 inch. As may be seen from the photomicrographs of FIGS. 12 and 13 (0.38× and 1.9×, respectively), increasing the orifice-to-substrate distance significantly degraded contrast as compared with the product of FIGS. 8 and 9, and FIGS. 10 and 11.

Many factors influence the degree to which liquid dye may be displaced or removed from a substrate in accordance with the teachings of this invention. For example, gas stream velocity, relative substrate speed, and orifice-to-substrate spacing have been found to influence appreciably the extent to which the impinging gas stream has sufficient energy to move or entrain a visually significant quantity of dye. The graph of FIG. 14 attempts to approximate the functional relationship between momentum flux and the percent of liquid dye removed from a dye-wet substrate of the chamber contemplated in the examples, for the case of a single jet. In the graph of FIG. 14, it may be seen that increasing the momentum flux, as by increasing gas stream velocity or decreasing the substrate-to-jet spacing, generally results in increased dye removal.

It should be understood that variations and modifications to the above teachings may be made without departing from the substance of the invention as described.

I claim:

1. A method for patterning the surface of a textile substrate, comprising the steps of:

(a) applying a quantity of liquid to said substrate:

(b) contacting said substrate with a plurality of pressurized gas streams, said streams being directed at said dye on said surface with sufficient energy to displace a quantity of said liquid dye on said substrate surface in the area impinged upon said streams;

(c) drying and fixing said liquid dye remaining on said substrate surface; and (d) moving said substrate along a path which includes said gas streams, wherein said plurality of gas streams are positioned across said path, and wherein said pressurized gas streams are interrupted individually in accordance with pattern information.

2. The method of claim 1 wherein portions of said gas streams impinging upon said substrate penetrate completely said substrate and expel liquid dye from said substrate surface directly opposite the area of penetration.

3. The method of claim 1 wherein portions of said gas streams impinging upon said substrate are reflected by said substrate and are thereby redirected outwardly from said substrate surface, carrying therewith liquid dye from said substrate surface impinged upon said streams.

4. A method for patterning the surface of a textile substrate carrying an unfixed liquid dye thereon, comprising (a) subjecting said dye carrying surface to a moving stream of pressurized air, said stream impinging on said surface and having sufficient velocity to displace physically a quantity of said dye from the area of impingement, said substrate reflecting stream portion outwardly from said substrate surface, said outwardly directed stream portion carrying therewith unfixed liquid dye; and (b) interrupting said stream as said stream moves over said surface in accordance with pattern information.

5. The method of claim 4 wherein at least a portion of said stream impinging said surface penetrates said substrate and emerges from the side of said substrate opposite said impinging stream, said emerging stream carrying therewith unfixed liquid dye from said substrate.

6. The method of claim 4 wherein said moving stream is comprised of substantially unheated air which is directed onto said surface at an impingement angle between about 25° and about 45°.

* * * * *

UNITED STATES PATENT AND TRADEMARK OFFICE

CERTIFICATE OF CORRECTION

PATENT NO. : 4,934,008

DATED : June 19, 1990

INVENTOR(S) : Daniel Taylor Mc Bride

It is certified that error appears in the above-identified patent and that said Letters Patent is hereby corrected as shown below:

Column 9, Claim 2, Line 23:

After the words "expel liquid dye from" add the words "areas of" before the words "said substrate surface"

Column 10, Claim 4, Line 11:

After the words "substrate reflecting" add the words " at least a portion of said stream and directing said reflected" before the words "stream portion" found on Line 12.

Signed and Sealed this

Second Day of November, 1993

*Attest:*

Bruce Lehman

BRUCE LEHMAN

*Attesting Officer*

*Commissioner of Patents and Trademarks*